United States Patent [19]

Nguyen et al.

[11] Patent Number: 4,718,953

[45] Date of Patent: Jan. 12, 1988

[54] HIGH EXPLOSIVE COMPOUND IN NITRATE SALT MATRIX

[75] Inventors: Anh D. Nguyen, Brossard; William B. Evans, Beaconsfield; Donald G. Ballantyne, Markham, all of Canada

[73] Assignee: C-I-L Inc., North York, Canada

[21] Appl. No.: 71,770

[22] Filed: Jul. 10, 1987

[30] Foreign Application Priority Data

Aug. 6, 1986 [CA] Canada ..... 515450

[51] Int. Cl.[4] ..... C06C 45/04

[52] U.S. Cl. ..... 149/17; 149/19.92; 149/88; 149/102; 149/104; 149/109.6

[58] Field of Search ..... 149/88, 17, 19.92, 102, 149/104, 109.6

[56] References Cited

U.S. PATENT DOCUMENTS 3,881,970 5/1975 Falconer et al. ..... 149/88

4,033,264 7/1977 Bolza et al. ..... 149/83

*Primary Examiner*—Stephen J. Lechert, Jr.

*Attorney, Agent, or Firm*—C. Brian Barlow

[57] ABSTRACT

A novel heterogeneous, cap-sensitive high explosive is provided which comprises a crystalline inorganic nitrate salt having dispersed throughout the matrix of the salt crystal a hydroxyalkyl nitrate fuel. Particularly preferred are ammonium nitrate crystals having dispersed therein ethylene glycol mononitrate. The crystalline high explosive is dry and free flowing and may be used per se, in admixture with bulking agents or fluidizing agents or may be used as a replacement for a substantial amount of nitroglycerine in conventional dynamite compositions.

10 Claims, No Drawings

HIGH EXPLOSIVE COMPOUND IN NITRATE SALT MATRIX

This invention relates to a novel class of high explosives. In particular, the invention relates to an explosive sensitizer or sensitizing agent which may be employed in the manufacture of a broad range of explosive compositions.

BACKGROUND OF THE INVENTION

Explosive compositions are generally classified as either molecular explosives, heterogeneous explosives or hybrid explosives. A molecular explosive is one in which the essential fuel and oxidizer elements are contained within the same molecule as, for example, in nitroglycerine or trinitrotoluene. A heterogeneous explosive comprises a mixture of separate, small oxidizer and fuel particles, such as in, for example, emulsion explosives. A hybrid explosive comprises a mixture of a molecular explosive and a heterogeneous explosive, such as, for example, nitroglycerine dynamite.

An objective of the explosives industry has been to increase the proportion of the lower cost oxidizer component and decrease the amount of the high cost molecular explosives component in various commercial hybrid explosive compositions. It has also been an objective to find compositions which can replace hybrid explosives without any sacrifice in performance. To a large extent, many of these objectives have been accomplished in recent years by the development of ammonium nitrate/fuel oil blasting agents (ANFO), aqueous ammonium nitrate slurry explosives (U.S. Pat. No. Re. 25,695 —Cook and Farnham), aqueous TNT slurry explosives (U.S. Pat. No. 2,930,685 —Cook and Farnham), water-bearing explosives containing a nitrogen-base salt sensitizer (U.S. Pat. No. 3,431,155 —Dunglinson and Lyerly), ethylene glycol mononitrate slurry explosives (U.S. Pat. No. 3,653,992 —Fee and Hurley), hydroxyalkyl nitrate sensitized explosives (U.S. Pat. No. 3,881,970 —Falconer and Holden) and water-in-oil emulsion explosives (U.S. Pat. No. 3,447,978 —Bluhm). Thus, a wide range of explosives for commercial blasting are now available in a variety of densities, strengths, sensitivities, physical form and price. Existing along side the various above-noted compositions are the conventional stick-type hybrid explosive containing nitroglycerine (NG) or ethylene glycol dinitrate (EGD) as the sensitizer, which explosive type maintains its commercial utility because of its high strength, reliability, sensitivity and competitive cost.

The disadvantages of the so-called NG dynamites lie in hazardous nature of the supersensitive NG or EGD ingredient and the health hazard associated with the vapours given off by these sensitizers. It would be desirable, therefore, if a low cost, safe and non-toxic substitute sensitizer could be found for NG or EGD which substitute sensitizer might also be of use in a wide range of explosive types.

By the practice of this invention, it has become possible to overcome many of the disadvantages and hazards associated with the handling of NG and EGD and to eliminate in whole or in part the need for the use of sensitive molecular explosives in hybrid compositions.

It is, therefore, an object of this invention to provide a novel explosive sensitizer which may be used as the essential sensitizing agent in a wide variety of explosive compositions and, in particular, as a whole or part substitute for NG and EGD in dynamite type compositions.

SUMMARY OF THE INVENTION

Briefly, the explosive sensitizer of the invention may be defined as a heterogeneous explosive in crystal form, a major portion of which crystal comprises an oxidizer and a minor portion of which crystal comprises a fuel. The explosive sensitizer of the invention is further characterized as having the fuel portion enveloped by or dispersed in a matrix of the oxidizer which oxidizer is in the form of a salt crystal.

To provide the explosive sensitizer of the invention, it is necessary to incorporate the fuel component into a matrix of the oxidizer. The process of the invention is generally defined as comprising the steps of heating an aqueous solution of a crystallizable oxidizer salt or mixture of oxidizer salts to form a solution, combining therewith a substantially soluble fuel component, cooling the fuel/oxidizer solution to ambient temperatures at which temperature the crystallization of the oxidizer salt takes place and collecting the formed oxidizer salt/fuel crystals.

The crystallizable oxidizer salt component of the invention may be any common oxidizer salt such as, for example, ammonium nitrate, sodium nitrate, calcium nitrate, potassium nitrate, or mixtures of these. The soluble fuel component of the invention are the hydroxyalkyl nitrates (HAN), in particular, ethylene glycol mononitrate (EGMN), propylene glycol mononitrate (PGMN) and hydroxychloropropyl nitrate (HCPN).

A practical method of preparing hydroxyalkyl nitrate (HAN) comprises reacting an oxirane ring compound with an aqueous solution of ammonium nitrate (AN) and nitric acid. Ethylene oxide, for example, when reacted with an AN/nitric acid solution produces EGMN in a diluted liquor of AN/nitric acid. Also present in the end-product AN/acid liquor may be minor amounts of diethylene glycol mononitrate, triethylene glycol mononitrate, ethylene glycol, diethylene glycol, triethylene glycol and diethyleneglycol dinitrate. The total reaction end-product, which may be referred to as EGMN liquor, may comprise from 1.5% to 20% by weight of water. More preferably, the water content of the liquor is in the range of 1.5% to 2.5%. The EGMN liquor is then heated to 50° C. and an excess of ammonium nitrate salt or other oxidizer salt is dissolved therein with stirring. The salt-saturated EGMN liquor is then cooled to ambient temperature at which temperature the salt particles crystallize, are recovered by filtration and are dried in air. The resulting recovered salt particles or crystals comprise from about 80% to 90% oxidizer salt and from about 20% to 10% EGMN plus minor amounts of water. The salt in appearance is a white crystal, dry to the touch and free flowing and, upon examination, is shown to consist of an oxidizer salt matrix through which is uniformly distributed portions of EGMN. The ratio of oxidizer salt to EGMN in the crystal is dependent on the water content of the precursor EGMN liquor.

EXAMPLE I

A series of explosives sensitizer crystals of the present invention were prepared from a range of HAN liquors containing various amounts of water. In each case, 1 kg of EGMN liquor was heated to 50° C. and 1.5 kg of ground ammonium nitrate (AN) were dissolved in the warm liquor. After dissolution of the AN, the saturated solution was cooled and the precipitated sensitizer crystals were collected by filtration and dried in air. The crystals were packaged in 25 mm diameter paper cartridges and initiated by means of blasting caps. The velocity of detonation (VOD) of each cartridge was measured. The results are shown in Table I below:

TABLE I

| Sample No. | % water in EGMN liquor | AN—EGMN Sensitizer Crystal | | | | Sensitivity | | |
|---|---|---|---|---|---|---|---|---|
| | | % AN | % EGMN | % Water | Oxygen Value | Density (g/cc) | Primer* | VOD (km/s) |
| 1 | 1.5 | 78.8 | 20.85 | 0.35 | +5.75 | 1.18 | R5 | (2.7) |
| 2 | 4.5 | 81.3 | 18.35 | 0.35 | +6.35 | 1.18 | R6 | (2.6) |
| 3 | 5.1 | 76.4 | 23.15 | 0.45 | +2.78 | 1.24 | R6 | (2.3) |
| 4 | 8.7 | 83.8 | 15.80 | 0.40 | +8.22 | 1.18 | R5 | (2.1) |
| 5 | 9.5 | 83.0 | 16.60 | 0.40 | +7.63 | 1.16 | R5 | (2.2) |
| 6 | 12.3 | 87.1 | 12.58 | 0.32 | +10.62 | 1.12 | R5 | (1.6) |
| 7 | 14.5 | 86.3 | 12.60 | 1.10 | +10.46 | 1.11 | R7 | (1.6) |
| 8 | 15.9 | 88.1 | 10.65 | 1.25 | +11.87 | 1.10 | R6 | (1.2) |
| 9 | 19.5 | 89.8 | 9.05 | 1.15 | +13.07 | 1.15 | E.B. | Failed |

*Caps designated R-n contain 0.1 g initiating composition and (n-3) × 0.05 g PETN 13 > n > 4 or (n-13) × 0.1 + 0.5 g PETN 16 > n > 14 base charge. E.B. indicates electric blasting caps containing .08 g initiating composition and .78 g PETN. F indicates a failure to detonate. All properties were measured at 5° C.

As can be seen from the results in Table 1, the sensitizer crystals of the invention are highly sensitive to blasting cap initiation (R5–R9) at high cartridge density. The amount of EGMN present in the crystal varies from 9% to over 20% depending on the water content of the precursor EGMN liquor.

The sensitizer crystals of the invention are characterized by a plate-like crystal structure particularly when made from low (less than 10%) water content EGMN liquor. At higher water levels in the EGMN liquor, the crystals tended to be more needle-like in shape resulting in less sensitive material.

EXAMPLE II

To demonstrate the intrinsic safety of the sensitizer crystals of the invention when exposed to impact, a standard impact sensitiveness test was performed on the product of Sample 2 of Table 1. A 10 kg steel drop weight was allowed to fall from various heights onto a sample of the crystals mounted on a steel anvil. The tests were repeated with the sample mounted on sandpaper. With steel-on-steel, the drop height ranged from 95–100 cm to produce a detonation 0 out of 10 times. With steel-on-sandpaper, the drop height was 45–50 cm. By comparison, the steel-on-steel drop height for nitroglycerine is from 10 to 20 cm.

EXAMPLE III

To further examine the sensitiveness and volatility of the sensitizer crystals of the invention, the product of Sample 2 of Table 1 was exposed to heat. The crystals were found to melt and to give off fumes at 200°–210° C. and were fully decomposed at 300°–310° C. and no evidence of any explosion was observed.

It is possible to utilize the sensitizer crystals of the invention as the principal component of a wide range of explosive types from small diameter, cap-sensitive products to large diameter non-cap-sensitive blasting agents. From among, for example, the various sensitizer crystals shown in Table 1, the formulator of explosives may select one or more of these crystal types to impart desired properties in a final product in which they constitute the sensitizing agent. While all of the Samples 1–8 demonstrate cap-sensitivity, it can be seen that the crystals of Samples 1–6, because of higher VOD, are preferably employed in cap-sensitive mixtures. Because of the lower VOD of Samples 7 and 8, compositions containing these crystals as sensitizers are, preferably, used for special applications such as, for example, the sealing of oil and gas wells.

EXAMPLE IV

The compositions as shown in Table II below were made as described in Example 1 except that the additional ingredients, where shown, were incorporated by blending by hand or in a small-sized Hobart (Reg. TM) mixer. The compositions were packaged in paper cartridges and detonated by various initiators.

TABLE II

| Ingredient % by weight | Mix #1 | | Mix #2 | Mix #3 | Mix #4 |
|---|---|---|---|---|---|
| AN—EGMN | 98.8 | | 25.0 | 45.0 | 90.0 |
| AN salt | | | 70.0 | 45.0 | |
| Guar Flour | 1.2 | | | 0.3 | 0.5 |
| Fuel | | | 5.0 | 3.0 | |
| Water | | | | 6.7 | 7.0 |
| Glass Balloons | | | | | 2.5 |
| Properties | | | | | |
| Density (g/cc) | 1.20 | 1.20 | 0.90 | 1.40 | 1.15 |
| Diameter (mm) | 25 | 50 | 75 | 75 | 50 |
| Minimum Primer | R-5 | R-4 | E.B.-A3* | 20 g** | R-10 |
| VOD | 2.5 | 4.0 | 3.0 | 2.5–3.0 | 4.0 |
| Water Resistance | | | | +24 hrs | +24 hrs |

*3.5 g RDX
**Pentolite Primer

Mix No. 1 in Table II comprised a dry sensitizer crystal as shown in Sample 2 of Table 1 to which was added a small amount of guar flour to enhance the water resistance of the crystals. Since the oxygen balance of the crystals employed was about +5 to +6, the only additional fuel required to achieve an oxygen balance for the composition was supplied by the guar flour. Mix No. 1 in both 25 mm and 50 mm diameter cartridges was sensitive to R5 and R4 initiators and detonated at a VOD of 2.5 and 4.0 km/s respectively. The properties of Mix No. 1 remained unchanged after 3 months storage at ambient temperatures.

Mix No. 2 in Table II comprised a dry sensitizer crystal as shown in Sample 2 of Table 1 to which was added a large proportion of ammonium nitrate and 5% of gilsonite as a fuel ingredient. This composition is detonable in 75 mm diameter paper cartridges at high VOD by means of an A3 electric blasting cap.

Mix No. 3 in Table II comprised equal proportions of a dry sensitizer crystal as shown in Sample 2 of Table 1 and ammonium nitrate prills. A small amount, 3%, of gilsonite was added as a fuel and 7% of a mixture of guar flour and water was mixed in. The resulting composition which had the consistency of a rubbery gel was packaged in 75 mm paper cartridges and was initiated by means of a 20 gm Pentolite primer at high velocity. The packaged product maintained detonability after more than 24 hours submersion in water. This high strength explosive, being both simple and economic to manufacture, provides a particularly useful product for large scale bulk blasting operations.

Mix No. 4 in Table II comprised a water-resistant, cap-sensitive explosive. To 90% by weight of sensitizer crystals as shown in Sample 2 of Table 1 was added 7.5% of a water/guar solution and 2.5% by weight of glass microspheres. When cartridged in 50 mm diameter paper cartridges, the composition was initiated by means of an R-10 initiator at good VOD. In addition, the composition demonstrated water resistance of over 24 hours.

The novel sensitizer crystal of the invention is demonstrated to be safe to use, convenient to transport and simple to compound into various types of explosive formulations. Because of its versatility, it may be employed as a sole sensitizer ingredient or may be used as part replacement for more costly or hazardous sensitizers. The crystal is highly sensitive to cap initiation yet possesses a lack of sensitiveness to impact and friction.

We claim:

1. A high explosive detonable by blasting cap in small diameter cartridges comprising an intimate mixture of a major amount of an inorganic nitrate oxidizer salt in crystalline form and a minor amount of a hydroxyalkyl nitrate fuel, the said hydroxyalkyl nitrate fuel being dispersed in the crystalline matrix of the said oxidizer salt.

2. A high explosive as claimed in claim 1 wherein the said inorganic oxidizer salt is selected from the group consisting of ammonium nitrate, sodium nitrate, calcium nitrate, potassium nitrate or mixtures of these.

3. A high explosive as claimed in claim 1 wherein the said hydroxyalkyl nitrate fuel is selected from ethylene glycol mononitrate, propylene glycol mononitrate, hydroxychloropropyl nitrate or mixtures of these.

4. A blasting explosive mixture comprising a high explosive as claimed in claim 1 in combination with additives selected from the group of bulking agents, fluidizing agents, thickening agents, density control agents, aeration agents, fuels and mixtures of these.

5. A blasting explosive mixture as claimed in claim 4 also containing an additional, sensitive high explosive.

6. A blasting explosive mixture as claimed in claim 5 wherein the additional high explosive is nitroglycerine/ethylene glycol dinitrate.

7. A process of making a heterogeneous explosive which comprises heating to at least 50° C. a hydroxyalkyl nitrate liquor which is the reaction product of an oxirane ring compound and an aqueous solution of ammonium nitrate and nitric acid, dissolving in said heated liquor an excess of an inorganic oxidizer salt, cooling the said salt-saturated liquor to crystallize salt particles therefrom and recovering the said salt particles from the said liquor.

8. A process as claimed in claim 7 wherein the said hydroxyalkyl nitrate liquor comprises less than 20% by weight of water.

9. A process as claimed in claim 8 wherein the said hydroxyalkyl nitrate liquor comprises from 1.5% to 2.5% by weight of water.

10. A process of making a heterogeneous explosive which comprises:

(a) reacting ethylene oxide with an aqueous solution of ammonium nitrate and nitric acid to form a reaction product comprising substantially ethylene glycol mononitrate in a diluted, aqueous ammonium nitrate/nitric acid liquor;

(b) heating the said liquor reaction product to about 50° C.;

(c) dissolving in the said heated liquor an excess of ammonium nitate salt; cooling the said salt-saturated liquor to crystallize therefrom explosive ammonium nitrate particles having dispersed in the crystalline matrix of the said particles up to 20% by weight of the salt of ethylene glycol mononitrate; and (d) recovering the said explosive salt particles from the said liquor.

* * * * *